US005882691A

United States Patent [19]

Conboy

[11] Patent Number: 5,882,691

[45] Date of Patent: Mar. 16, 1999

[54] AUTOMATIC DRY WALL COMPOUND APPLICATOR

[76] Inventor: John S. Conboy, 2235 Devonsbrook Dr., Chesterfield, Mo. 63005

[21] Appl. No.: 811,768

[22] Filed: Mar. 6, 1997

[51] Int. Cl.[6] ..... B05C 17/015; E04F 21/06

[52] U.S. Cl. ..... 425/87; 222/262; 222/389; 425/214

[58] Field of Search ..... 425/11, 12, 87, 425/90, 94, 97, 458, 214; 222/256, 262, 389, 385, 334, 626; 417/570, 571, 553; 15/235.3, 235.7

[56] References Cited

U.S. PATENT DOCUMENTS

| | | | |
|---|---|---|---|
| 4,919,604 | 4/1990 | Wilson | 425/458 |
| 4,946,077 | 8/1990 | Olsen | 222/256 |
| 4,996,799 | 3/1991 | Pound et al. | 51/241 VS |
| 5,033,197 | 7/1991 | Irvello | 33/42 |
| 5,343,982 | 9/1994 | Min | 184/24 |
| 5,535,926 | 7/1996 | Blitz et al. | 222/334 |
| 5,695,788 | 12/1997 | Woods | 15/235.5 |

OTHER PUBLICATIONS

H.A. Guden Co., Brochure "The GGSX Gas Spring" (undated).

AVM Inc., Product Sheet No. 040596 (undated).

AVM Inc., Product Sheet No. 030895 (undated).

AVM Inc., Product Sheet No. 020895 (undated).

*Primary Examiner*—James P. Mackey

*Attorney, Agent, or Firm*—Polster, Lieder, Woodruff & Lucchesi, L.C.

[57] ABSTRACT

An automatic dry wall applicator having an applicator head connected to a translucent body with a quick release mechanism for easy cleaning and a gas spring dispensing system which moves a piston head in the body to dispense dry wall compound. A loading mechanism uses a manual pump which generates sufficient force to overcome the gas spring pressure to force dry wall compound from a reservoir into the head and body to retract the piston head during loading. The piston rod engages a cam brake which frees the rod during loading and locks the piston head from dispensing unless the cam is manually released from the rod. In one form of the invention, an on-off valve closes the applicator head during loading and can be opened to permit dispensing of dry wall compound.

17 Claims, 7 Drawing Sheets

AUTOMATIC DRY WALL COMPOUND APPLICATOR

BACKGROUND OF THE INVENTION

This invention relates to dry wall taping and in particular to a machine for applying dry wall compound to joints and corners where dry wall tape and tape on corner beads is applied.

Applying dry wall mix to joints is a very labor intensive job if done manually. If a dry wall taper uses present machines, the job is very demanding physically and in time causes injury to the back and shoulders of the taper because of the weight of the device and the physical force necessary to eject the taping compound from the device and apply it to the joint.

Accordingly, a principal object of this invention is to provide a machine in which a manually operated pump injects dry wall compound into the applicator from a supply receptacle and a gas operated spring assembly is used to eject the dry wall compound through a nozzle on the applicator in a controlled manner without requiring intense physical force from the operator of the device. An automatic brake assembly allows loading of dry wall compound into the applicator, but acts automatically to prevent ejection of dry wall compound unless the brake is released by the operator.

Another object is to provide an applicator which easily comes apart to facilitate cleaning the dry wall compound out of the applicator parts. Another object is to provide an applicator which can be placed in an upright position for easy "hands free" loading of dry wall compound into the applicator. Still another object is to provide an applicator that can be used for inside and outside corners as well as flat joints, and can be used for finish coating of dry wall compound as well as for first coats.

These and other objects and advantages will become apparent hereinafter.

BRIEF SUMMARY OF THE INVENTION

The invention is embodied in a dry wall compound applicator comprising a main dry wall compound retaining cylinder having a dispensing and filing head on one end and a brake housing and handle receptacle on the other end. Inside the handle is a nitrogen filled gas spring whose actuating shaft extends into the cylinder and has a dispensing piston connected to its free end. A brake and brake release controls movement of the actuating shaft. A filler tube connects a dry wall compound receptacle to a fill valve in the head to allow a manually operated pump to fill dry wall compound into the cylinder and compress the gas spring. A valve on the dispensing end of the dispensing head is closed during filing of the cylinder and compression of the gas spring, but is open during controlled application of the dry wall compound. The brake controls operation of the gas spring so that when the brake is released and the valve opened, compound is dispensed from a universal applicator nozzle on the dispensing head. The brake automatically locks when filling is stopped at any stage during filling and also during dispensing, unless manually released by the operator.

BRIEF DESCRIPTION OF THE SEVERAL VIEWS OF THE DRAWINGS

In the drawings, wherein like numbers refer to like parts wherever they occur.

DETAILED DESCRIPTION OF THE INVENTION

The following detailed description illustrates the invention by way of example and not by way of limitation. This description will clearly enable one skilled in the art to make and use the invention, and describes several embodiments, adaptations, variations, alternatives and uses of the invention, including what presently is believed to be the best mode of carrying out the invention.

Figure 1:
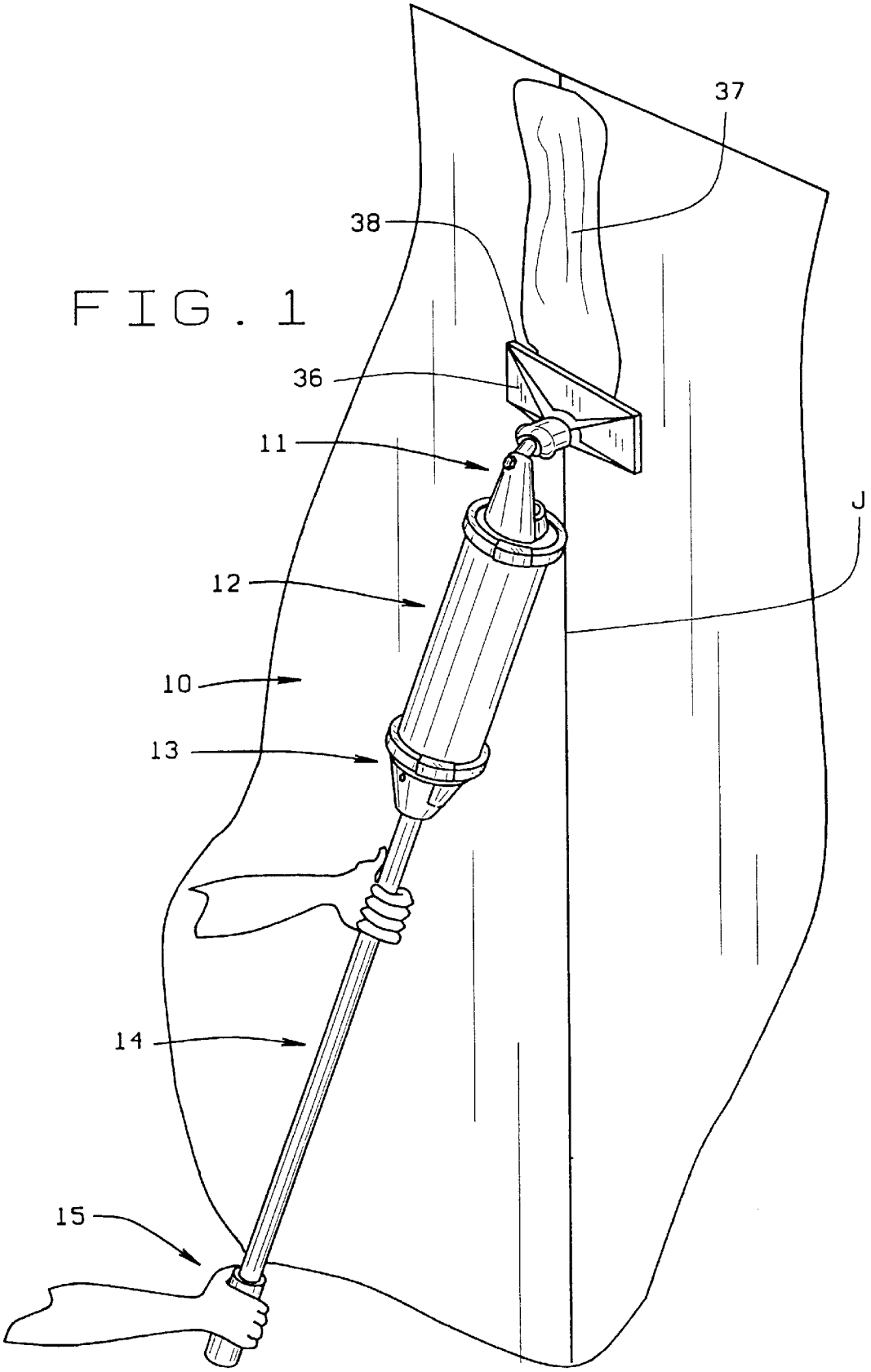
FIG. 1 is a fragmentary perspective view showing use of the applicator on a flat wall joint.
Figure 2:
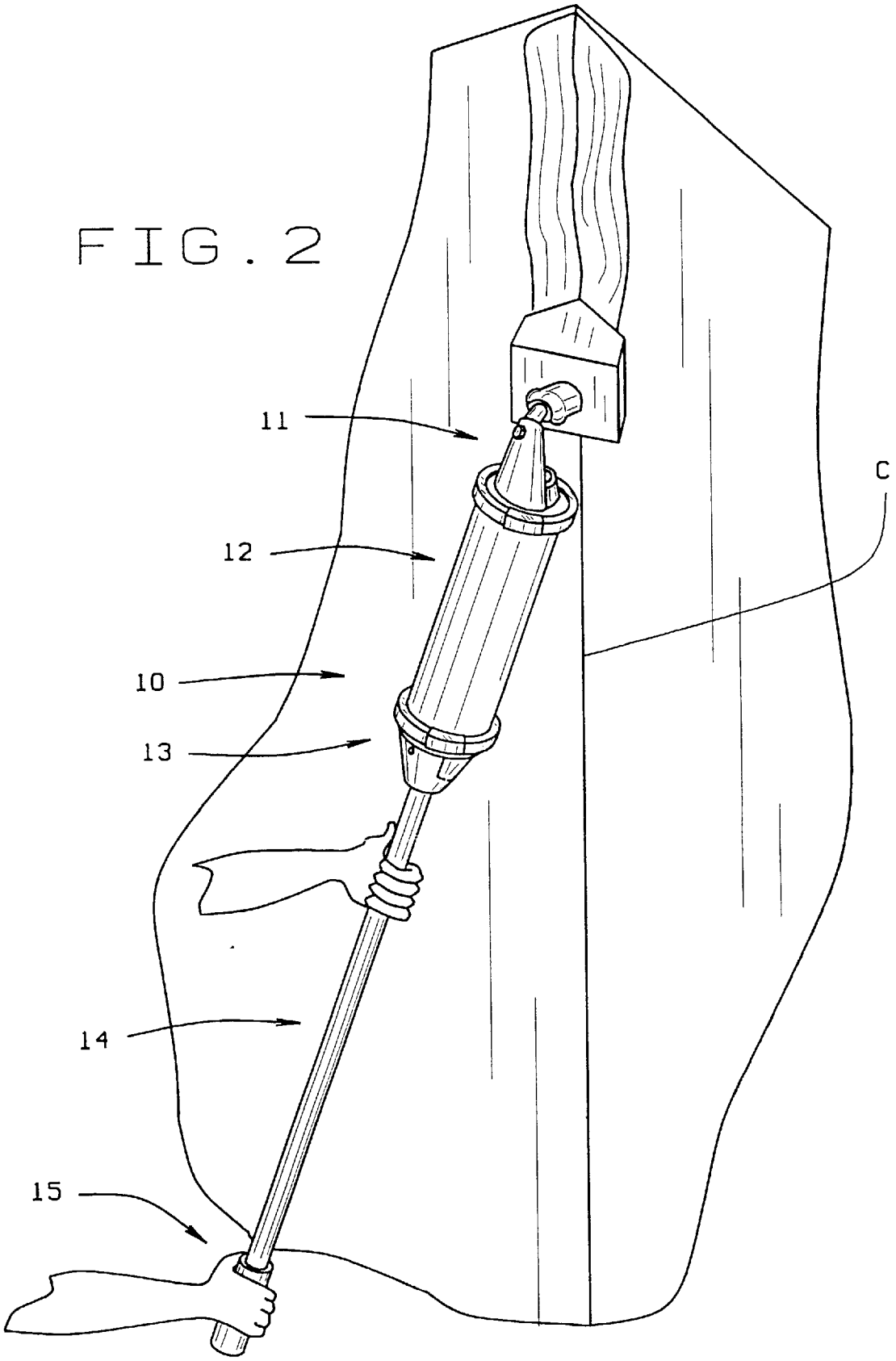
FIG. 2 is a view similar to FIG. 1 but showing use of the applicator on a corner joint.

FIGS. 1 and 2 show the dry wall compound dispensing device 10 in operation. The device 10 comprises a compound dispensing and filling nozzle assembly 11, a main compound retaining cylinder 12, a brake and handle housing 13, a handle 14, which contains a gas spring, and a brake release 15. FIG. 1 shows the use of the device 10 on a flat wall joint "J" and FIG. 2 shows its use on an inside corner "C".

Figure 3:
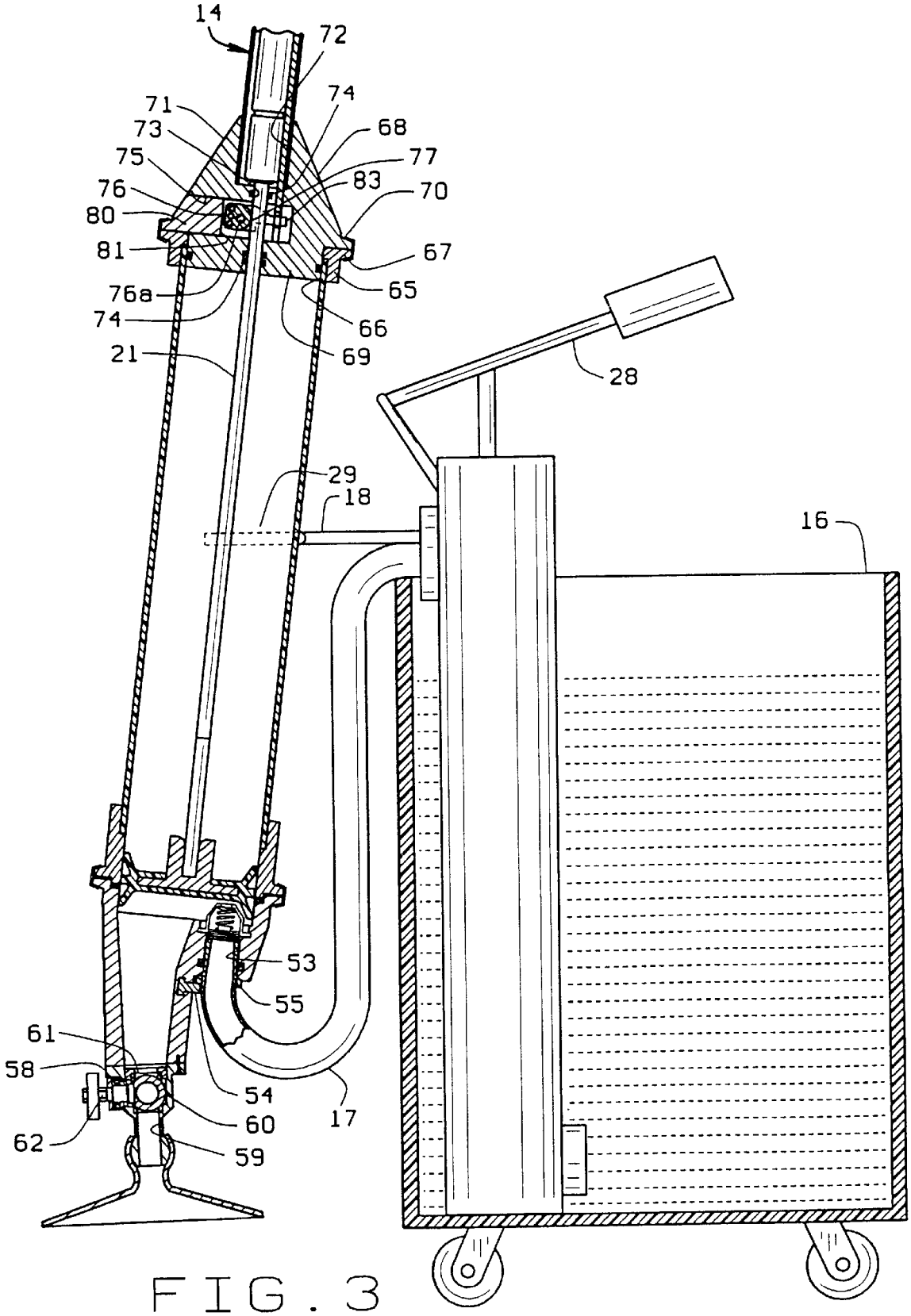
FIG. 3 is a fragmentary vertical sectional view showing loading of dry wall compound into the applicator with the gas cylinder in elevation.
Figure 4:
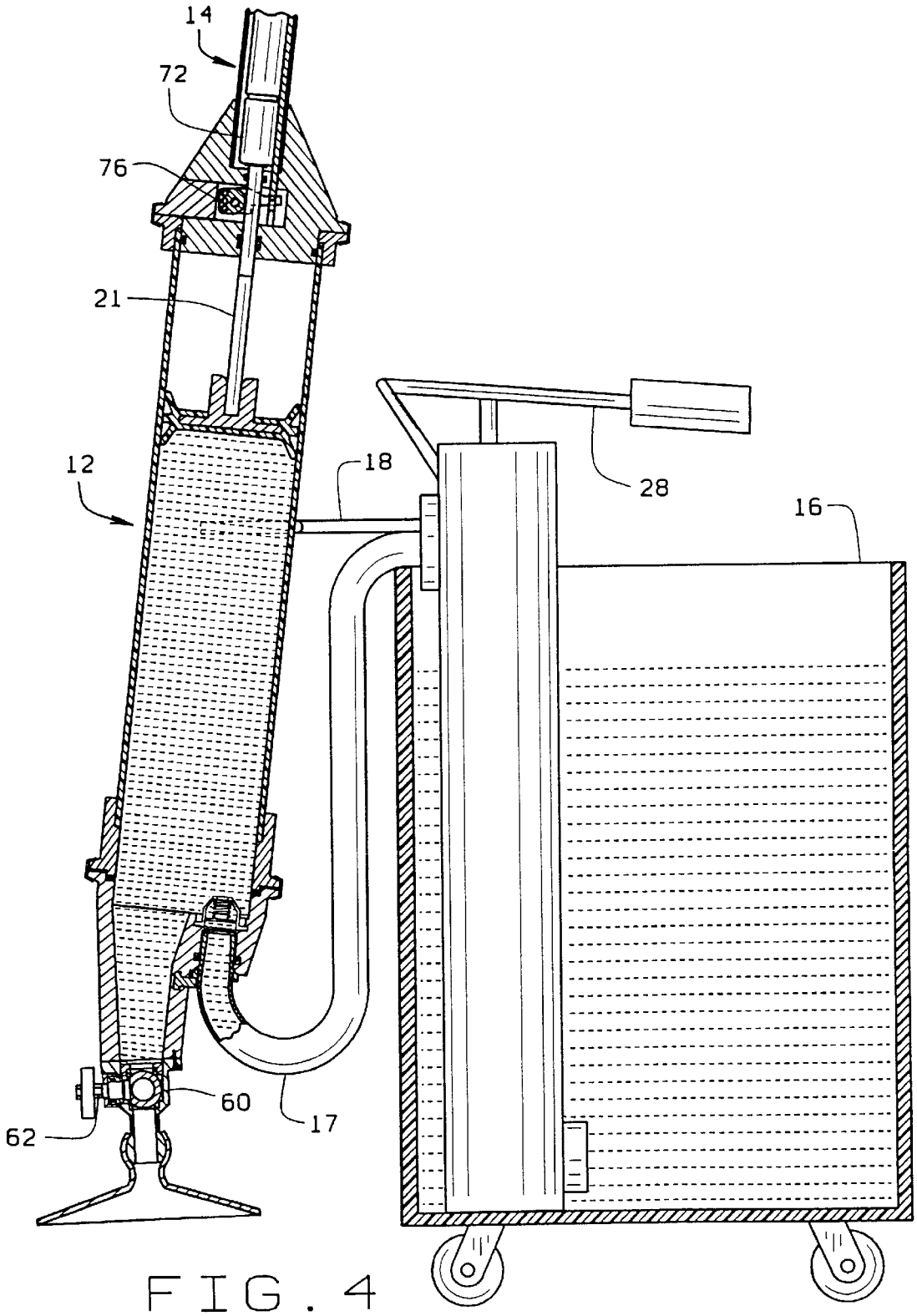
FIG. 4 is a view similar to FIG. 3 but showing the applicator partially filled.

FIGS. 3 and 4 show the device 10 attached to a compound loading receptacle 16 by means of a fill tube 17. A support stand 18 attached to the receptacle 16 has a semi-circular cradle 29 which engages the outer surface of the cylinder 12 to help support the device 10 during filling.

Figure 5:
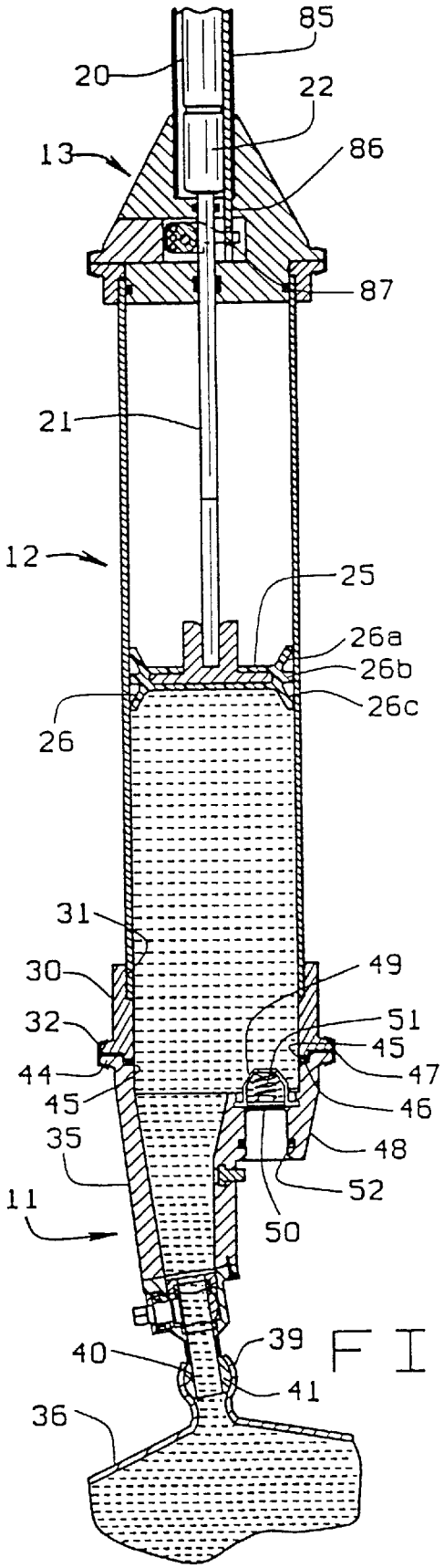
FIG. 5 is a fragmentary vertical sectional view showing the applicator in dispensing condition and the gas cylinder in elevation.
Figure 6:
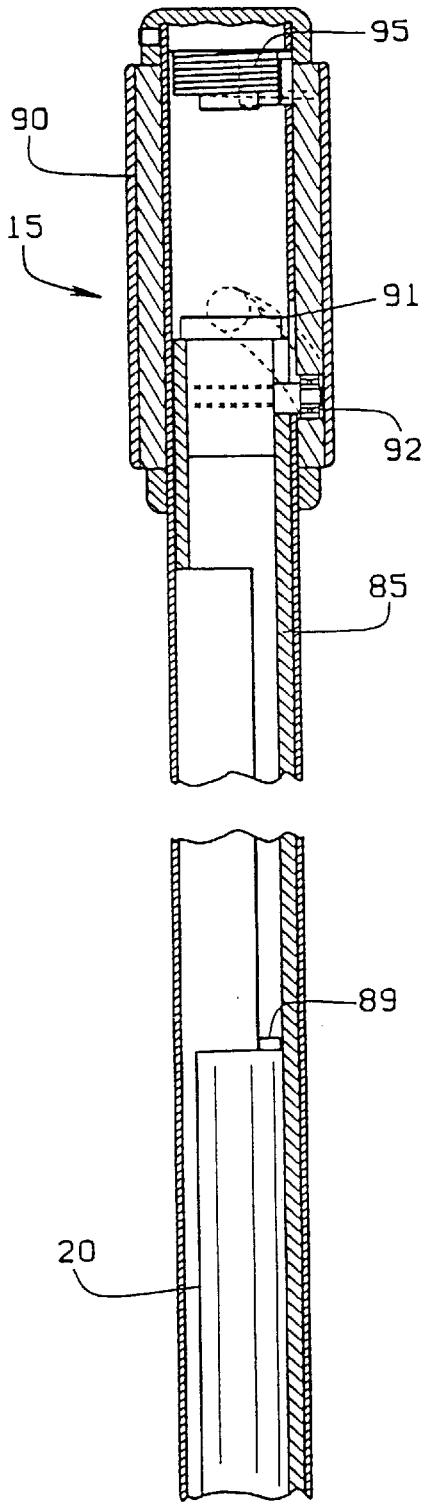
FIG. 6 is a fragmentary vertical sectional view of the handle portion of the applicator with the gas cylinder in elevation.
Figure 9:
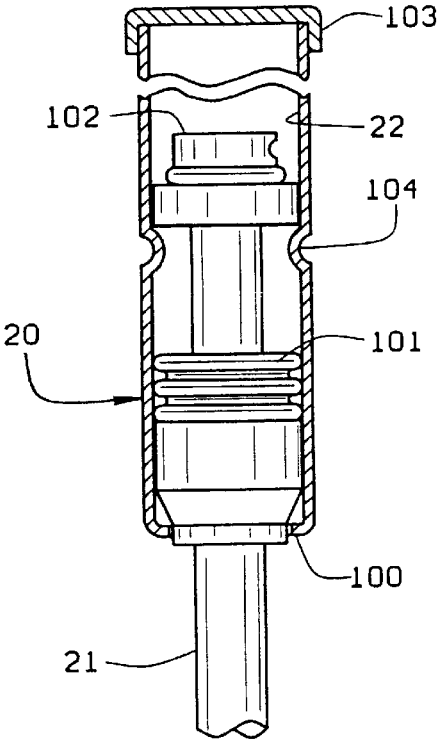
FIG. 9 is a foreshortened fragmentary vertical sectional view of the gas cylinder.

FIGS. 5, 6 and 9 also show the gas spring assembly 20 which is a standard article of commerce such as that sold by AVM, Inc. of Marion, S.C. under the name GGSX Gas Spring. The preferred gas spring has a 15–18" stroke and a force of about 60 pounds. The force can vary from about 40 to about 70 pounds. The rates of discharge can vary depending on the viscosity of the compound.

The gas spring assembly 20 includes an actuating shaft 21 which extends outside a first end of the gas spring housing 22 through the brake and handle housing 13 into the interior of the compound cylinder 12.

Attached to the leading end of the shaft 21 is a compound dispensing head 25 which includes a set of flexible wiping fingers 26 to wipe the interior of the cylinder 12 and push the compound out of the cylinder 12 during operation. The fingers 26 are trifurcated with one finger 26*a* directed toward the interior of the cylinder 12, one finger 26*b* positioned perpendicular to the side wall of the cylinder 12, and the third finger 26*c* directed toward the dispensing end of the cylinder 12. The fingers 26 prevent the dry wall compound from getting behind the head during either filling or dispensing. This structure is shown in more detail in FIG. 5. A compressed air cylinder can be used as the gas spring assembly 20.

The cylinder 12 preferably is made of a transparent plastic, such as polycarbonate, so that the operator can visually determine how much dry wall compound is in the cylinder 12.

Attached to the front end of the cylinder 12 is a cylinder front head 30 which has an internal annular counterbore 31 to engage the front end of the cylinder 12 and an external annular lip 32 at the leading edge. The head 30 preferably is of aluminum and is secured to the cylinder 12 by a suitable adhesive. The head 30 also can be of a suitable plastic to reduce weight.

The nozzle assembly 11 is comprised of two elements, a front nose 35 and a dispensing nozzle 36. Universal finishing heads or dry wall heads 36 can be adapted to be used as the nozzle 36. These are conventional in the industry and FIG. 1 shows a nozzle 36 which is hollow and has a dispensing opening 38. The nozzle 36 dispenses a layer of dry wall compound 37 approximately the same width as the dispensing opening 38 in the nozzle 36. The nozzle apex 39 has an internal spherical pocket 40 to accommodate a ball 41 on the leading edge of the nose 35. The pocket 40 and ball 41 define a ball joint assembly which allows universal pivoting of the nozzle 36 with respect to the rest of the device 10 to accommodate the user in applying dry wall to ceilings, walls, etc. The nozzle 36 is snapped onto the ball 41 to attach the nozzle 36 to the device 10.

The nose 35 is hollow and tapers from rear to front. It preferably is made of aluminum and includes an annular rim 44 and a counterbore 45 at its larger rear end. The rim 44 is coextensive with the front head lip 32. A O-ring seal 46 fits in the counterbore 45 and seals the nose 35 to the cylinder 12. The nose 35 can be made of plastic to reduce weight.

A quick release snap rim retainer 47 holds the rims 32 and 44 in assembled condition and permits quick and rapid removal of the nozzle 11 from the body 12 for cleaning. One can merely use a hose or pail of water to clean the tool after use by disassembling the nozzle 11 and body 12. Another method of fastening the nozzle 11 to the body 12 is by a threaded connection.

A loading boss 48 is positioned on the nose 35 adjacent to the rim 44 and is provided with a conventional spring loaded loading valve assembly which includes a valve retainer 49, a valve plate 50 and a valve spring 51. The loading boss 48 is provided with an external loading port 52 which is adapted to accommodate a loading nozzle 53 on the end of the fill tube 17. The nozzle 53 slides into the port 52 and is locked in place by engagement of locking shoulders 54 on the boss 48 and 55 on the nozzle 53.

On the smaller dispensing end of the front nose 35 is the ball joint and valve assembly 58 which includes the ball joint 41 previously described. The assembly 58 has a throughbore 59 which extends through the ball 41 and a ball valve seat 60 which retains a ball valve 61 which can be rotated by a handle and stem 62 into open or closed position. The ball valve 61 is closed during filling of the dispenser and open during application of dry wall compound.

Figure 10:
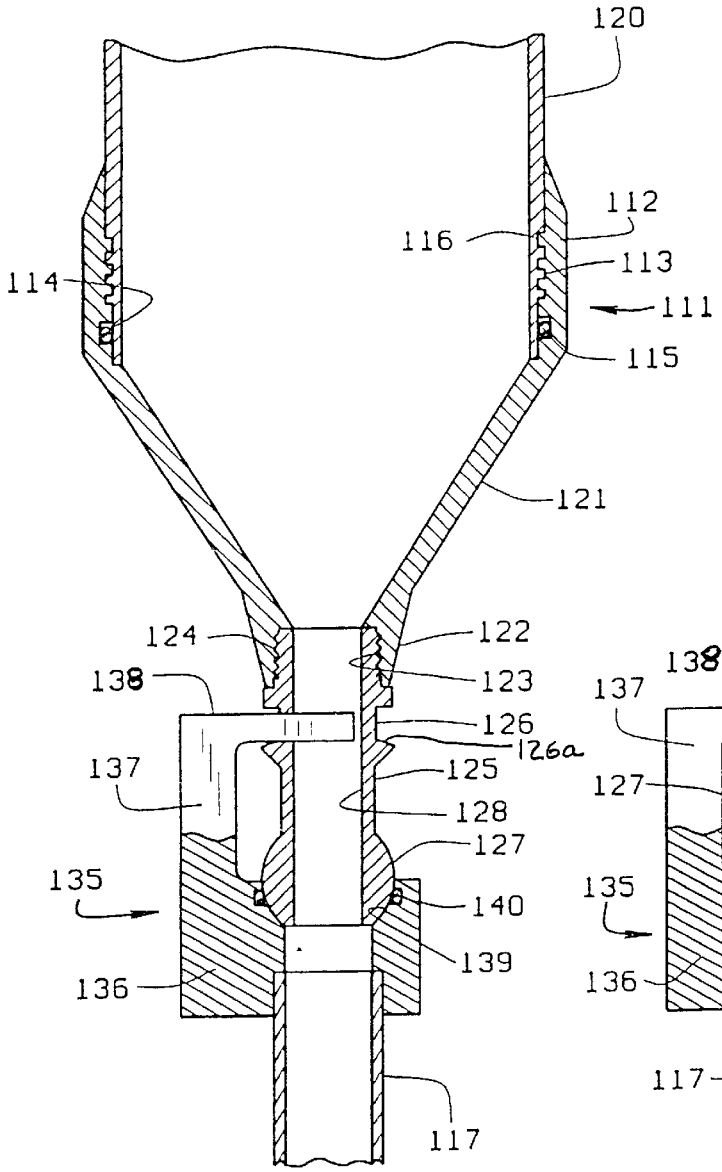
FIG. 10 is a fragmentary sectional view party in elevation of a modified filling assembly.
Figure 12:
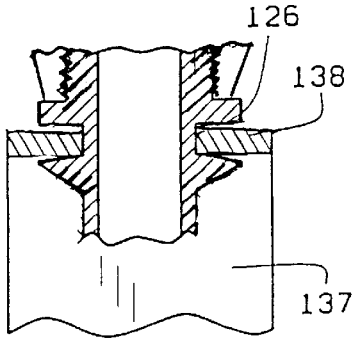
FIG. 12 is an enlarged vertical sectional view of the attachment of the fill ture to the application.
Figure 11:
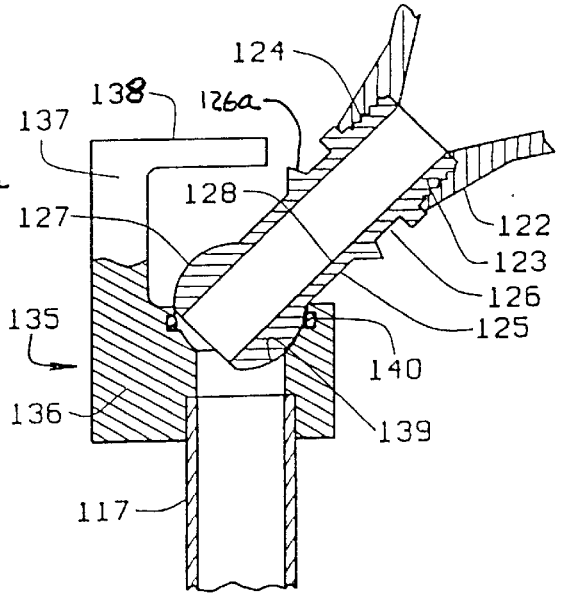
FIG. 11 is a fragmentary sectional view partly in elevation of the modification of FIG. 10 being moved into filling position.

An alternative filling method is to provide a snap clamp on the free end of the fill tube 17 so that the fill tube 17 can be snapped onto the ball 41 and the device 10 is filled through the throughbore 59 of the assembly 58. In this construction, the ball valve 61 is eliminated as seen in FIGS. 10 and 11. The need for a loading boss 48 and the associated port and valve also is eliminated. This modification will be described in more detail hereinafter.

On the opposite end of the cylinder 12 is the brake and handle housing 13. The housing 13 is comprised of two parts, the first of which is an annular ring 65 having a counterbore 66, which accommodates the cylinder 12, and an annular rim 67. The second part 68 has a boss 69 which fits inside the end of the cylinder 12, an annular rim 70 which engages the rim 67, and a tapered nose 71 which is provided with a counterbore 72 to accommodate the hollow handle 14. The second part 68 has a throughbore 73 provided with internal seals 74 to guide the gas spring shaft 21 into and out of the cylinder 12.

Figure 7:
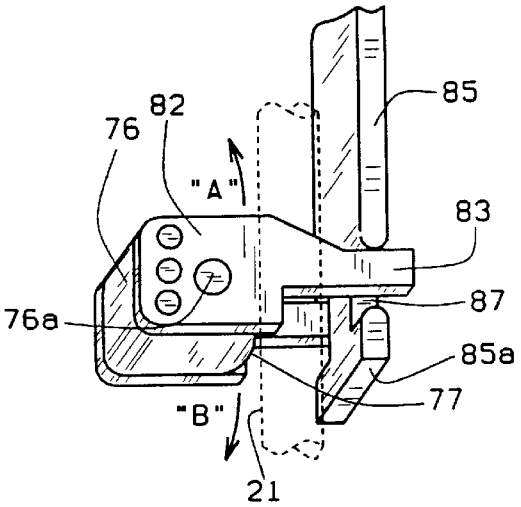
FIG. 7 is a perspective view of the brake mechanism.
Figure 8:
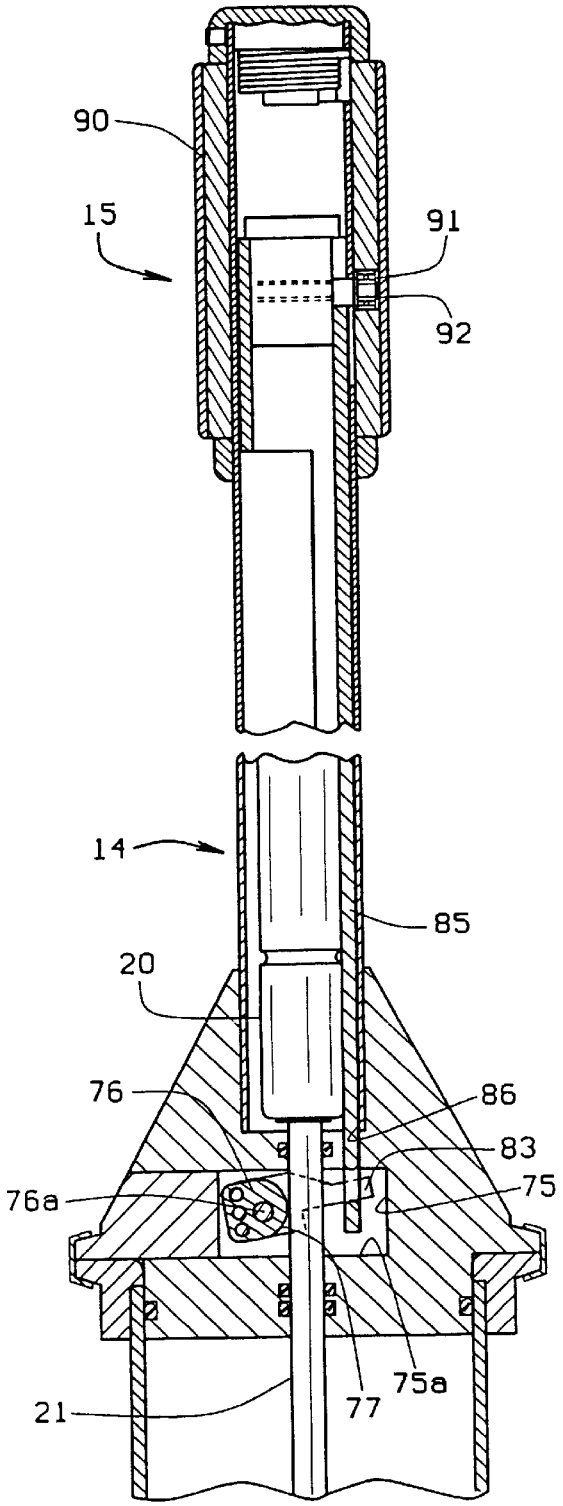
FIG. 8 is a foreshortened fragmentary vertical sectional view of the applicator handle and brake mechanism with the gas cylinder in elevation.

A slot 75 is positioned in the top of the housing 13 and extends past the throughbore 73. Located in the slot 75 is a locking cam 76 which has a cam surface 77 positioned over the air spring shaft 21 (FIGS. 7 and 8). The cam 76 pivots freely rearwardly (arrow A in FIG. 7) to allow the gas spring shaft 21 to move into the gas spring, during loading of the cylinder 12. When the gas spring shaft 21 attempts to move forward, the cam 76 pivots in the forward direction ("B" in FIG. 7) and the cam surface 77 engages the shaft 21 to lock the gas spring 20 in inoperative position. A lock support plate 80 is secured in the slot 75 and includes a portion of the rim 70. The plate 80 is provided with a slot 81 which accommodates the cam 76 and cam side plates 82 which have downwardly depending legs 83 which pass on each side of the shaft 21, but do not engage it. The cam support plates 82 are fastened to the cam 76. The cam 76 is pivoted on the cam support rod 76*a*.

Also positioned in the handle 14 is a brake actuator rod 85. The rod 85 slides through an opening 86 in the housing 13 into the slot 75. On the leading end of the rod 85 inside the slot 75 are two cutout areas 87. The cam side plate legs 83 fit into the cutout areas 87 so that movement of the rod 85 will move the cam 76. The cutouts 87 are slightly larger than the width of the legs 83 so that the cam 76 is free to move in direction "A" during filling without requiring movement of the rod 85. This allows the shaft 21 to move rearwardly during filling. However, when filling is stopped, the cam 76 rocks in direction "B" to engage and lock the shaft 21. Not until the brake actuator rod 85 is moved rearwardly is the shaft 21 free to move forwardly to dispense compound.

Intermediate the length of the handle 14 is an air spring support 89 which supports and retains the back end of the air spring 20 in the handle 14.

On the free end of the handle 14 is the brake release assembly 15 (FIGS. 6 and 8) which includes a rotatable hand hold 90 which has a raceway 91 which curves angularly toward the free end of the handle 14. A rotatable bearing 92 runs in the raceway 91 and is connected to the actuator rod 85. Fixed to the hand hold 90 is a return spring 95 mounted on the handle 14. As the hand hold 90 is rotated in a first direction it moves the bearing 92 in the raceway 91 and moves the actuator rod 85 toward the rear of the handle 14. This moves the cam 76 in direction "A" and frees the air spring shaft 21 for forward movement to dispense dry wall compound. When the hand hold 90 is released, the spring 95 turns it in the opposite direction to move the bearing 92 forwardly in the track 91 and thus move the actuator rod 85 forwardly to free the cam 76 for movement in direction "B", thus locking the air spring shaft 21 from forward movement and effectively stopping dispensing of dry wall material.

The front edge 85*a* of the actuator rod 85 engages the front wall 75*a* of the slot 75 to prevent locking of the cam 76 to the shaft 21 by rotation of the hand hold 90. Rotation of the hand hold 90 acts only to unlock the cam 76 to permit dispensing of dry wall compound. When the hand hold 90 is released, the return spring 95 moves the rod 85 forwardly to release the cam 76 and allow it to freely engage and lock the shaft 21.

THE GAS SPRING

As previously stated, the gas spring assembly 20 is a standard item of commerce made by AVM, Inc. and comprises a steel cylindrical housing 22 having the shaft 21 positioned inside and extending out through a first end 100. A heavy duty multi-lobe seal 101 is positioned near the first end 100 inside the housing 22 to prevent leakage of gas and/or fluids when the shaft 21 is extended and retracted. On the end of the shaft 21 inside the housing 22 is a piston face 102 and Nitrogen gas is behind the piston head 102 and the second end 103 of the housing 22. An annular groove 104 is formed in the housing 22 to limit extension of the shaft 21. When there is no load on the head 25, the gas in the gas spring 20 extends the shaft 21 outwardly and when there is a load on the head 25, which exceeds the gas pressure, the gas is compressed in the housing 22.

OPERATION

To fill the cylinder 12, the ball valve assembly 58 first is closed by rotating the stem 62 and ball valve 61 to closed position. Since there is no pressure on the dispensing head 25, the shaft 21 is in fully extended position as shown in FIG. 3.

After the ball valve 61 is rotated to closed position using the handle 62, the fill tube 17 from the compound receptacle 16 is connected to the loading port 52 by engagement of the lock shoulders 54 and 55, on the port 52 and the loading nozzle, respectively. A conventional hand pump 28 is used to pump dry wall compound from the reservoir 16 to the loading port 52. The pressure generated by the pump 28 is sufficient to open the valve plate 50 to admit compound to the nozzle assembly 11. As the compound fills up the nose 35 it is prevented from flowing out by the closed ball valve 61. The pressure from the pump 28 is sufficient to overcome the gas pressure in the gas spring 20 so the dispenser head 25 and the shaft 21 are moved upwardly or rightwardly, compressing the gas in the gas spring 20 and filling up the cylinder 12. This is shown sequentially in FIGS. 3 and 4.

The movement of the shaft 21 upwardly disengages the cam 76 from the brake actuator rod 85 because of the play between the slot 87 in the rod 85 and the cam plate legs 83. When filling is stopped, the shaft 21 moves downwardly a short distance until the cam brake 76 engages the shaft 21 to hold the dispensing head 25 in its inoperative position. Only when the hand hold 90 is rotated to move the bearing 92 into the raceway 91 and pull the rod 85 rearwardly to free the cam 76 from the rod 21, does the gas cylinder expel compound from the dispenser. Thus the actuating shaft 21 is always locked unless it is manually disengaged by rotation of the grip 90.

After the cylinder 12 is filled, the fill nozzle 53 is disengaged, the valve 50 is shut by the spring 51 and the dispensing device is ready for use by the operator.

It is seen that the cam brake 76 locks the air spring actuator rod 21 in inoperative position when the dispenser is not in use so that discharge of dry wall compound is not effected unless the cam 76 is released by the operator moving the handle 90.

Modification

A modification of the method of filling the dispenser is shown in FIGS. 10 and 11. These figures also show a modified filling nozzle assembly 111 and a modified fill tube 117. The nozzle 111 has a cylindrical portion 112 which is provided with internal threads 113 and an internal groove 114 which houses an O-ring seal 115. The threads 113 mate with external threads 116 on the main compound retaining cylinder 120. Thus, the nozzle 111 can be rapidly threaded on and off the cylinder 120 for easy cleaning.

The nozzle 111 has a tapered nose 121 which terminates in a discharge opening 122. The opening 122 has internal threads 123 which mate with external threads 124 on a combination filling and discharge nozzle 125.

The discharge nozzle 125 has an external groove 126 between the threaded end 124 and a ball 127 on its second or free end. The nozzle 125 also is provided with a through-bore 128. The groove 126 has its bottom side 126*a* sloped outwardly.

The fill tube 117 has a connector 135 on its free end. The connector 135 has a body portion 136 secured to the fill tube 117 and an L-shaped arm portion 137 at one edge of the body 136. The arm 137 has a bifurcated retainer 138 portion adapted to engage the slot 126 to secure the fill tube 117 to the nozzle 111 for filling. The connector body 136 has a dish shaped seat 139 designed to engage the ball 127 during filling. A seal 140 is positioned in the opening 139 and seals the ball 127 during filling to prevent escape of dry wall compound.

To fill, the nozzle 125 is rotated into the seat 139 and the arm 138 slides past the inclined side 126*a* and is snapped into the groove 126. This holds the dispenser 10 in engagement with the compound receptacle 16. After filling the ball 127 is removed from the seat 139 and a dispensing head 36 is snapped onto the ball 127 as previously described.

In view of the above, it will be seen that the several objects and advantages of the present invention have been achieved and other advantageous results have been obtained.

As various changes could be made in the above constructions without departing from the scope of the invention, it is intended that all matter contained in the above description or shown in the accompanying drawings shall be interpreted as illustrative and not in a limiting sense.

What is claimed is:

1. A dry wall compound applicator comprising (a) a body for holding a supply of dry wall compound;

(b) an applicator head on a first end of said body, said applicator head having a discharge nozzle;

(c) a gas spring operator on a second end of said body, said gas spring operator having loading and discharge conditions for dispensing dry wall compound from the body through the applicator head discharge nozzle when in discharge condition, the gas spring operator having a sealed gas chamber containing a compressible gas and a piston head and rod which extend out of the gas chamber into the body, the piston head being axially movable through the body and the rod being axially movable through the body and the sealed gas chamber;

(d) a loading mechanism for admitting dry wall compound into the body against the piston head to move the rod into the gas chamber when the gas spring operator is in loading condition, and (e) a braking mechanism for controlling the operation of the gas spring operator in its discharge condition, said braking mechanism- having a cam positioned adjacent to the piston rod and pivoted to engage the rod when the gas operator is in discharge condition, and a brake control lever for disengaging the cam from the rod to allow the gas operator to move the piston head toward the discharge nozzle and discharge dry wall compound.

2. The applicator of claim 1 including a shut off valve in the applicator head for interrupting flow of dry wall compound through the discharge nozzle when dry wall compound is being loaded into the body.

3. The applicator of claim 1 including a handle for holding the applicator, the gas spring and the brake control lever being positioned in the handle and the handle being connected to the body.

4. The applicator of claim 3 including a rotatable member on the free end of the handle remote from its connection to the body, the rotatable member being connected to the brake control lever and constructed to move said lever longitudinally rearwardly when the member is rotated.

5. The applicator of claim 1 wherein the handle is tubular and has an arcuate slot therein, the rotatable member is positioned on the tubular member over the slot, and a follower is movably positioned in the slot and connected to the member and to the brake control lever, wherein rotation of the member moves the follower in the slot and also moves the brake control lever longitudinally through the handle.

6. The applicator of claim 2 wherein the shut off valve includes a rotatable ball having a throughbore aligned with the discharge nozzle, a stem extending out of the applicator head and a handle on the stem for rotating the ball to move the throughbore into and out of alignment with the discharge nozzle.

7. The applicator of claim 1 wherein the loading mechanism includes a boss positioned on the head and provided with a loading port adapted to engage and retain a portable loading tube connected to a loading pump, a valve on said port having open and closed positions to admit dry wall compound into the head in open position and to close off said port and retain dry wall compound in the head when in closed position.

8. The applicator of claim 7 including a reservoir for dry wall compound, an applicator retainer on said reservoir adapted to engage the applicator body and hold the applicator in an upright position during loading.

9. The applicator of claim 8 wherein the pump is manually operated and is adapted to be positioned in the reservoir.

10. The applicator of claim 9 wherein the loading tube is rigid and has a discharge end engageable with the loading port and means for attaching the tube firmly to the head.

11. The applicator of claim 1 wherein the body is translucent or transparent whereby the level of dry wall compound can be ascertained.

12. The applicator of claim 1 wherein the applicator head and the body have engaging lips at their junction and including a quick release connection for holding the lips together during use and for permitting easy detachment of the head and body after use for rapid cleaning.

13. The applicator of claim 1 wherein the applicator head and the body have a threaded connection for easy separation for cleaning.

14. The applicator of claim 1 wherein the loading mechanism is connectable to the discharge nozzle.

15. The applicator of claim 14 wherein the discharge nozzle is connected at a first end to the applicator head and has a ball on a second end with a throughbore between said ends.

16. The applicator of claim 15 wherein the loading mechanism includes a loading tube connected to a supply of drywall compound which can be pressurized, a connector on the free end of the loading tube for engaging the ball on the second end of the discharge nozzle to place the tube in communication with the nozzle throughbore.

17. The applicator of claim 16 including a seat in the connector for sealingly engaging the nozzle ball, and means for securing the connector to the nozzle between the ends of the nozzle.

* * * * *